United States Patent [19]

Okouchi

[11] Patent Number: 4,797,017

[45] Date of Patent: Jan. 10, 1989

[54] WIRE DOT MATRIX PRINTER CAPABLE OF PRINTING LETTERS ON A PLURALITY OF SUPERPOSED SHEETS OF PAPER

[75] Inventor: Satoshi Okouchi, Yokohama, Japan

[73] Assignee: Kabushiki Kaisha Toshiba, Kanagawa, Japan

[21] Appl. No.: 910,968

[22] Filed: Sep. 24, 1986

[30] Foreign Application Priority Data

Sep. 27, 1985 [JP] Japan ..... 60-213784

[51] Int. Cl.[4] ..... B41J 11/20; B41J 9/38

[52] U.S. Cl. ..... 400/59; 101/93.03; 400/57; 400/157.3; 400/166

[58] Field of Search ..... 400/55-57, 400/59, 157.3, 166, 124; 101/93.03, 93.04, 93.05

[56] References Cited

U.S. PATENT DOCUMENTS

| | | | |
|---|---|---|---|
| 4,368,666 | 1/1983 | Kazawa | 400/157.3 X |
| 4,403,874 | 9/1983 | Payne | 400/157.3 X |

FOREIGN PATENT DOCUMENTS

| | | | |
|---|---|---|---|
| 38277 | 4/1981 | Japan . | |
| 49286 | 5/1981 | Japan | 400/59 |
| 120374 | 9/1981 | Japan . | |
| 117677 | 9/1981 | Japan | 400/59 |
| 14071 | 1/1982 | Japan | 400/59 |
| 96868 | 6/1982 | Japan | 400/59 |
| 128882 | 8/1983 | Japan . | |
| 73854 | 4/1985 | Japan | 400/124 |

*Primary Examiner*—Paul T. Sewell

*Attorney, Agent, or Firm*—Finnegan, Henderson, Farabow, Garrett, & Dunner

[57] ABSTRACT

Disclosed is a wire dot matrix printer capable of printing letters on a plurality of superposed sheets of paper, in which there is provided a drive current adjuster for continuously increasing and decreasing the drive current of solenoids which move printing wires, in association with a distance adjuster for adjusting the relative distance between the front end of the printing wires and a platen roller, thereby the impact force of the printing wires can be continuously changed in accordance with the number of superposed sheets of paper.

1 Claim, 3 Drawing Sheets

WIRE DOT MATRIX PRINTER CAPABLE OF PRINTING LETTERS ON A PLURALITY OF SUPERPOSED SHEETS OF PAPER

The present application claims priority of Japanese Patent Application No. 60-213784 filed on Sept. 27, 1985.

FIELD OF THE INVENTION AND RELATED ART STATEMENT

The present invention relates to a wire dot matrix printer provided with a printing head in which a plurality of printing wires are displaced by corresponding solenoids to carry out printing, and is capable of printing letters on a plurality of superposed sheets of paper.

Until now, wire dot matrix printers provided with a printing head in which a plurality of printing wires are displaced by corresponding solenoids to carry out printing, have been widely used with computers and word-processors.

Referring to FIG. 5 which is a plan view illustrating the arrangement of the printing section of a conventional wire dot matrix printer, reference number 1 denotes a printing head in which a plurality of printing wires are displaced by corresponding solenoids to carry out printing, 2 denotes a carriage on which the printing head 1 is mounted, 3 denotes a cylindrical carriage rail serving as a guide for carriage 2 when the latter moves, and 4 denotes a platen roller serving as a backing member for paper during printing operation.

Further, reference number 5 denotes an indicator plate, for setting the number of superposed papers, belonging to a distance adjusting means (which is explained hereinunder) for moving a carriage rail 3 slightly in the direction of the arrow A to increase or decrease the relative distance between the front end of the printing wires in the printing head 1 and the platen roller 4, 6 denotes a control lever for operating the distance adjusting means , and 7 denotes a frame to which the indicator plate 5 is attached and to which the control lever 6 is journalled.

In the above-mentioned conventional wire dot matrix printer, when a plurality of superposed papers are set with carbon papers alternately interposed , printing can be carried out simultaneously on a plurality of papers.

The control lever 6 mentioned above is for actuating the distance adjusting means in accordance with the number of superposed papers, and for adjusting the impact force of the printing wires during printing (hereinafter the impact force will be referred to as "printing power").

Referring to FIG. 6 which is a side view illustrating the arrangement of the distance adjusting means as one example, reference number 5 is the above-mentioned indicator plate, 6 denotes the above-mentioned frame, 8 denotes a cam plate which is secured to the control lever 6 by a cam shaft 9 with the frame 7 being held therebetween, and to which the carriage rail 3 is eccentrically secured, and 10 denotes a microswitch for changing over the printing power of the printing head 1 in two stages.

In this wire dot matrix printer, when the control lever 6 is displaced, the cam plate 8 is rotated by the cam shaft 9, and therefore, the carriage rail 3 is rotated in accordance with the rotation of the cam plate 8 while the carriage rail 3 is in the eccentric condition so that the carriage rail 3 is moved a short distance in the direction of the arrow A.

When the carriage rail 3 is displaced, the front ends of the printing wires in the printing head 1 are slightly displaced.

In this printer, when the control lever 8 is displaced in accordance with the indicator plate 5, the distance between the printing head 1 and the platen roller 4 can be adjusted in five stages.

Further, the lower end section of the control lever 8 is formed in a sector shape, and the lower end section of this sector shape is formed with teeth which are meshed with a projection provided at a predetermined position of the frame 7; it is thereby possible to provide a suitable click feeling when operating the control lever 6.

However, the above-mentioned printer sometimes causes a problem in that the printing power of the printing head 1 which is changed over in two stages by means of a microswitch 10, cannot be adjusted accurately in accordance with the number of superposed papers.

For example, for less than five superposed sheets of paper, the printing power is generally changed over between the printing of three superposed papers and the printing of four sheets of paper, and therefore, the printing power is equal in the cases of printing 1 to 3 sheets, and in the cases of printing 4 to 5 sheets respectively.

That is, printing is performed for one or two superposed sheets of paper under a printing power corresponding to three superposed papers while printing is performed for 4 superposed sheets of paper under a printing power corresponding to five superposed sheets of paper; and therefore, the printing power is too much for 1, 2 or 4 superposed sheets of paper, possibly incurring the problems of embossing and holing of the papers, increasing noise and shortening the lives of the ink ribbon and the printing head.

OBJECT AND SUMMARY OF THE INVENTION

The present invention is devised to solve the above-mentioned problems inherent to conventional wire dot matrix printers, and therefore, one object of the present invention is to provide a wire dot matrix printer capable of printing letters on a plurality of superposed sheets of paper, for which printing can be performed under an optimum printing power in accordance with the number of superposed sheets of paper so that it is possible to avoid embossing and holing of paper, increasing noise, and reducing the lives of the ink ribbon and printing head.

That is, according to the present invention, there is provided a wire dot matrix printer comprising a printing head having a plurality of printing wires which are displaced by the corresponding solenoids, a platen roller opposed to the printing head and serving as a backing member for paper upon printing, a distance adjusting means for increasing and decreasing the relative distance between the front end of the printing wires in the printing head and the platen roller, and a drive current controlling means for continuously increasing and decreasing drive current for the solenoids in accordance with the printing power of the printing head in accordance with the number of superposed sheets of paper in addition to the adjustment of relative distance between the printing head and the platen roller.

BRIEF DESCRIPTION OF THE INVENTION

DETAILED DESCRIPTION OF PREFERRED EMBODIMENT

The present invention will be detailed with refernce to the drawings.

Figure 1:
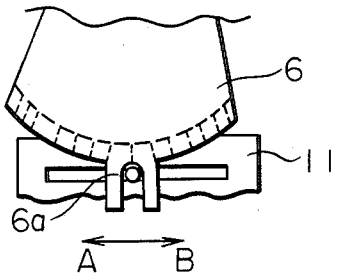
FIG. 1 is a side view illustrating an arrangement of an essential part of one preferred embodiment of the present invention.

Referring to FIG. 1 which is a side view illustrating the arrangement of an essential part of the present invention, reference number 6 denotes a control lever, as is similar to those of conventional wire dot matrix printers, for rotating a cam plate to which a cylindrical carriage is eccentrically secured, to increase and decrease the relative distance between the front ends of printing wires in a printing head and a platen roller, 6*a* denotes a U-like projecting part projecting from the lower end of the control lever 6, 11 denotes a variable resistor having a slider associated with the projecting part 6*a*.

Figure 2:
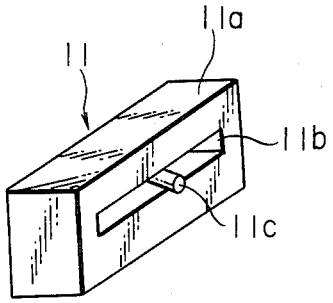
FIG. 2 is an external perspective view illustrating a variable resistor used in the embodiment shown in FIG. 1.

The variable resistor 11 is arranged, as shown in FIG. 2, such that when the slider 11*c* is displaced in a slit 11*b* within a body 11*a*, the resistance value of a resistor disposed in the body 11*a* continuously changes.

Further, referring to FIG. 3 which is the printing head drive circuit of the embodiment, this circuit incorporates a one shot monostable multivibrator (which will be hereinbelow referred to as "monomulti") 12 which changes the pulse width of fire pulses determining the drive current of a solenoid for displacing the printing wires.

This monomulti 12 is a single IC drive to which a CR time constant circuit composed of the afore-mentioned variable resistor 11 and a capacitor 13 is externally attached. Further, the pulse width of fire pulses received by the monomulti 12 is changed in accordance with the time constant which is determined by the resistance value of the variable resistor 11 and the capacitance of the capacitor 13. Further, the fire pulses delivered from the monomulti 12 are applied to the base of a transistor 14. Further, the emitter of this transistor 14 is connected to a 24 V d. c. power source while the collector is connected to one end of the terminal of a solenoid 15 for driving a printing wire. Further, the other end of the terminal of the solenoid 15 is connected to the collector of a transistor 16 having its emitter grounded.

Further, the base of the transistor 16 is connected to the output line of a NOR gate 20. The NOR gate 20 receives both a printing data signal for selecting whether the corresponding dot is black or not and the afore-mentioned fire pulses. The fire pulses delivered to the NOR gate 20 are used as a strobing signal for the printing data signal.

Further, when the level of fire pulses is low while the level of the printing data signal is low, the level of output of the NOR gate 20 becomes high, and therefore, both transistors 16, 14 are energized so that drive current runs through the solenoid 15.

Further, the collector of the transistor 14 is grounded through a diode 17, and a Zener diode 18 and diode 19 are in series connected between the emitter of the transistor 14 and the collector of the transistor 16.

Further, NOR gates 20, solenoids 15, transistors 16, Zener diodes 18 and diodes 19 are arranged, in a number corresponding to the number of printing wires, respectively in parallel.

Figure 4:
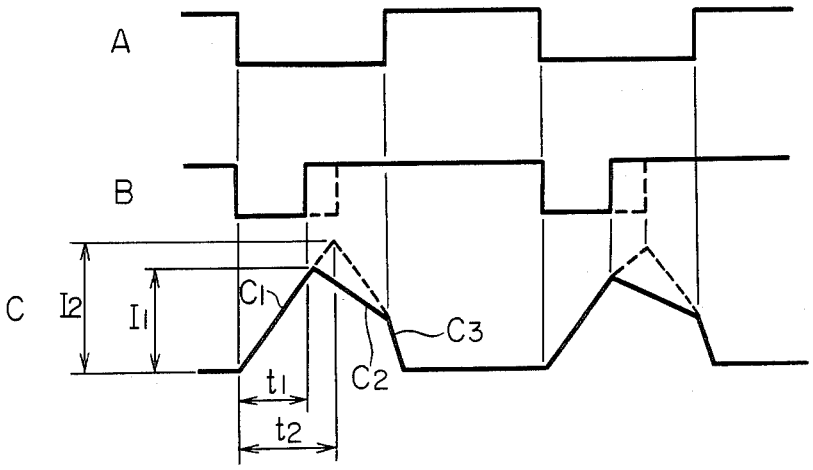
FIG. 4 shows the waveforms of signals at several points shown in the circuit of FIG. 3.
Figure 3:
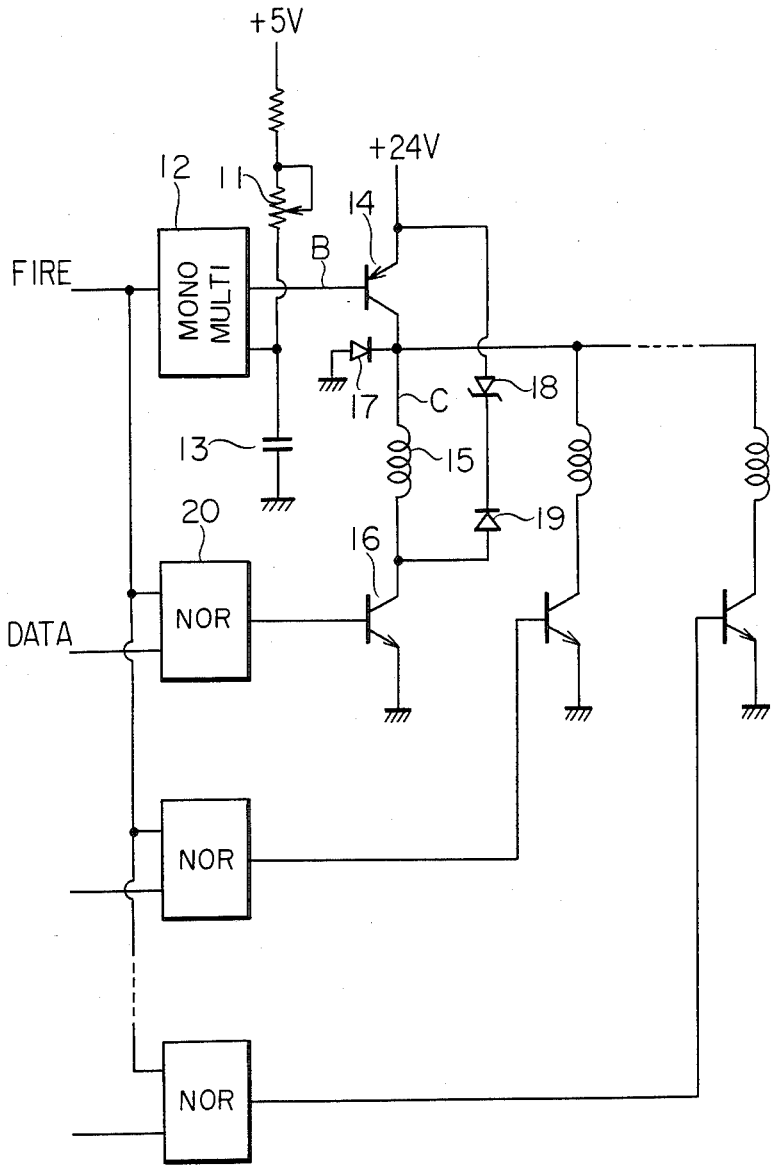
FIG. 3 is the circuit which is one component of a printing head drive circuit system used in the above-mentioned embodiment.
Figure 5:
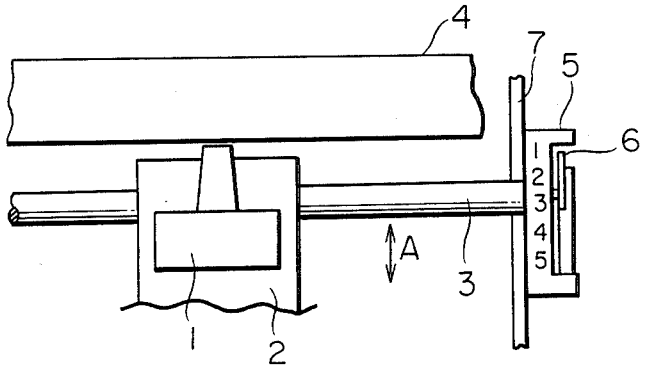
FIG. 5 is a plan view illustrating the arrangement of the printing section of a conventional wire dot matrix printer.
Figure 6:
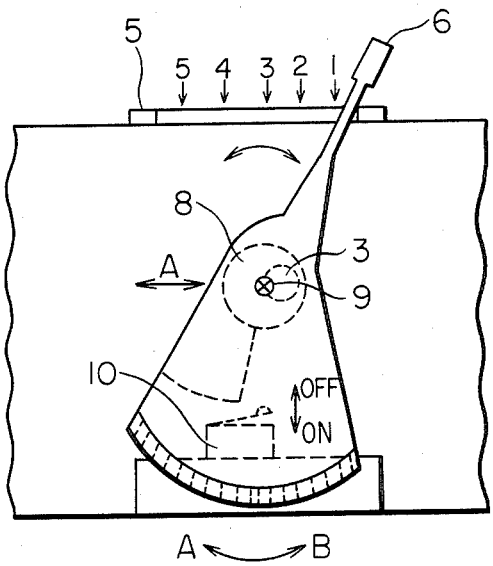
FIG. 6 is side view illustrating one example of the arrangement of a distance adjusting means in the conventional device shown in FIG. 5.

FIG. 4 shows the waveforms of signals indicated at several points in the circuit of FIG. 3.

In this figure, reference number A denotes the wave-from of fire pulses delivered to the monomulti 12 and the NOR gate 20, B denotes the waveform of fire pulses delivered from the monomulti 12, and C denotes the waveform of current running through the solenoid 15.

In the circuit in this embodiment, when the level of the fire pulses becomes low, the output level of the monomulti 12 becomes low during the period which is proportional to the time constant determined by the resistance value of the variable resistor 11. Further, when the level of the printing data signal becomes low during this period, the level of output of the NOR gate 20 becomes high so that both transistors 14, 16 are energized.

Further, as shown at C in FIG. 4, during the period to the time when the level of output of the monomulti 12 becomes high again, the current of the solenoid 15 continues to rise (period $C_1$).

When the level of output of the monomulti 12 becomes high, the transistor 14 is de-energized, but the transistor 14 is left to be energized during the period during which the level of the fire pulses delivered to the NOR gate 20 is low and the level of the printing data signal is low.

At this time, an induced current is generated in the solenoid 15. This current is directed to ground through the diode 17 so that the current running through the solenoid 15 is lowered moderately during the period until the level of the fire pulses becomes high (period $C_2$).

When the level of the fire pulses delivered to the NOR gate 20 becomes high, the transistor 16 is de-energized, and therefore, the current running through the solenoid 15 is directed to the Zener diode 18 through the diode 19 As a result, the current running through the solenoid 15 abruptly drops (period $C_3$).

In the circuit of this embodiment, as clearly understood from B and C in FIG. 4, if the pulse width of the fire pulses delivered from the monomulti 12 is $t_1$, the maximum value of current running through the solenoid takes the value of $I_1$, while if the pulse width of the fire pulse delivered from the monomulti 12 is $t_2$, the maximum value of the current running through the solenoid takes the value of $I_2(t_1<t_2, I_1<I_2)$.

That is, in the circuit of this embodiment the maximum value of current passing through the solenoid 15 is proportional to the pulse width of the fire pulse delivered from the monomulti 12.

In the circuit of this embodiment, when the resistance value of the variable resistor 11 is increased and decreased by manipulating the control lever 6, the pulse width of the fire pulses delivered from the monomulti 12 varies, and therefore, the magnitude of the drive current of the solenoid 15 varies in proportion to the variation of the pulse width. Further, since the printing power of the printing wire is proportional to the integrated value of drive current of the solenoid 15 during the low level period of the fire pulses, it can be understood that the printing power contimuously varies in accordance with the operation of the control lever 6.

In this embodiment, although it has been explained that the width of the fire pulses delivered from the monomulti 12 is changed by changing the resistance value of the variable resistor 11 in the CR time constant circuit which is externally attached to the monomulti 12, the same result can be obtained if the capacitance value of the capacitor 13 is changed.

In this arrangement, it is necessary to have the capacitor 13 variable, and therefore, to arrange it such that the capacitance of the capacitor 13 varies continuously in accordance with the displacement of the control lever 16. As mentioned above, the wire dot matrix printer has a drive current adjusting means for contimuously changing the drive current of the solenoid in accordance with the number of superposed sheets of paper, being associated with a distance adjusting means for increasing and decreasing the relative distance between the front end of the printing wires in the printing head and the platen roller, and therefore, the printing power of the printing wires can be continuously changed, thereby it is possible to always provide optimum printing power.

As a result, it is possible to suppress embossing and holing of the taper and noise to a minimum, and therefore, it is also possible to prolong the life of the ink ribbon and the life of the printing head.

What is claimed is:

1. A wire dot matrix printer for printing letters on a plurality of superposed sheets of paper, comprising:

a printing head including a plurality of solenoids and a plurality of printing wires which are each displaced by a corresponding one of the solenoids;

a platen roller opposed to the printing head;

distance adjusting means for increasing and decreasing the relative distance between the front ends of the printing wires in the printing head and the platen roller, the distance adjusting means including a control lever for adjusting a relative distance between the front ends of the printing wires of the printing head and the platen roller; and control means cooperable with the distance adjusting means for controlling the drive current to the respective solenoids to continuously adjust the drive current of the solenoids in accordance with the position of the control lever, the control means comprising:

a one-shot monostable multivibrator generating variable-width printing control signals to continuously adjust the drive current of the solenoids, and a capacitance/resistance circuit including a variable resistor coupled to the one-shot monostable multivibrator and to the control lever such that adjustment of the control lever is operable to adjust the resistance value of the variable resistor to change the pulse width of the printing control signals and adjust the drive current of the solenoids in accordance with the position of the control lever.

* * * * *